US006626410B2

(12) United States Patent
Marcotte et al.

(10) Patent No.: US 6,626,410 B2
(45) Date of Patent: Sep. 30, 2003

(54) PORTABLE HIGHWAY SIGN STAND

(75) Inventors: Dennis L. Marcotte, Durham, OR (US); David A. Stoudt, Clackamas, OR (US)

(73) Assignee: Custom Stamping & Manufacturing Co., Portland, OR (US)

( * ) Notice: Subject to any disclaimer, the term of this patent is extended or adjusted under 35 U.S.C. 154(b) by 0 days.

(21) Appl. No.: 09/769,557

(22) Filed: Jan. 24, 2001

(65) Prior Publication Data

US 2002/0096617 A1 Jul. 25, 2002

(51) Int. Cl.[7] ..... F16M 11/20
(52) U.S. Cl. ..... 248/548; 248/188.6
(58) Field of Search ..... 248/188.6, 188.7, 248/170, 548, 900; 40/607, 608, 606, 612; 52/98

(56) References Cited

U.S. PATENT DOCUMENTS

| | | | | |
|---|---|---|---|---|
| 1,269,212 A | | 6/1918 | Poole | |
| 1,487,635 A | | 3/1924 | Watts | |
| 1,903,683 A | | 4/1933 | Nute | |
| 2,141,067 A | | 12/1938 | Miller | |
| 3,124,329 A | | 3/1964 | Ransom et al. | |
| 3,912,405 A | * | 10/1975 | Katt | 403/2 |
| 3,913,518 A | * | 10/1975 | Kaplan | 166/63 C |
| 4,032,248 A | * | 6/1977 | Parduhn et al. | 404/10 |
| 4,038,769 A | | 8/1977 | Werner | |
| 4,137,662 A | | 2/1979 | Baumer | |
| 4,183,695 A | | 1/1980 | Wilcox | |
| 4,490,062 A | * | 12/1984 | Chisholm | 403/2 |
| 4,565,466 A | | 1/1986 | Daggs | |
| 4,676,015 A | | 6/1987 | Stoudt | |
| 4,888,894 A | * | 12/1989 | Brown, Jr. | 40/606 |
| 4,951,407 A | | 8/1990 | Werner | |
| 5,489,077 A | | 2/1996 | Stoudt | |
| 5,535,555 A | * | 7/1996 | Boyd et al. | 52/99 |
| 5,624,210 A | | 4/1997 | Baldwin et al. | |
| 5,732,911 A | | 3/1998 | Kulp et al. | |
| 6,113,055 A | * | 9/2000 | Salman | 248/548 |
| 6,210,066 B1 | * | 4/2001 | Dent | 403/2 |
| 6,264,162 B1 | * | 7/2001 | Barnes et al. | 248/548 |
| 6,283,421 B1 | * | 9/2001 | Eason et al. | 248/170 |
| 6,308,927 B1 | * | 10/2001 | Leahy | 248/548 |
| 6,322,027 B1 | * | 11/2001 | Hsu | 248/177.1 |

OTHER PUBLICATIONS

Little Buster™ brochure by TrafFix Devices, Inc., Jan. 1997.
Work–Site Signage Catalog, MDI® Traffic Control Products, date unknown.
DYNAFLEX brochure, Dicke Tool Company, 1985.
Quadra Flex V™ brochure, date unknown.
Power Cell® One Piece PC Models brochure, Sign Up Corporation, date unknown.
Power Cell® Two Piece PC Models brochure, Sign Up Corporation, date unknown.
Mini–Stand® Series MS–2000X brochure, Sign Up Corporation, date unknown.
Traffic Alert Products for Safety and Savings brochure, Sign Up Corporation, date unknown.

* cited by examiner

*Primary Examiner*—Kimberly Wood
(74) *Attorney, Agent, or Firm*—Kolisch Hartwell, P.C.

(57) ABSTRACT

A yieldable portable highway sign stand is provided. The sign stand comprises a base, and a sign support coupled to and extending upwardly from the base for supporting a highway sign above the ground. The sign support includes a generally rigid, generally upright portion having a first breakaway section that is yieldable along a first direction when subjected to a sufficient load at least partially along the first direction, and a second breakaway section that is yieldable along a second direction when subjected to a sufficient load at least partially along the second direction.

22 Claims, 4 Drawing Sheets

PORTABLE HIGHWAY SIGN STAND

TECHNICAL FIELD

The present invention provides a portable highway sign stand that is configured to yield toward the ground when struck with a sufficient force by a vehicle.

BACKGROUND

Highway safety signs are often displayed on portable sign stands in the vicinity of temporary highway conditions, such as construction activity or road damage, to notify drivers of the upcoming danger. Portable highway sign stands are typically designed to be lightweight, sturdy and collapsible so that they may be quickly set up or taken down, readily moved, and easily stored when not in use. The stands generally include a base supported on collapsible legs, a sign support member extending upward from the base for displaying a sign, and a sign mount coupled to the top of the sign support member.

When used on a road with fast-moving traffic, the stands may pose a danger to inattentive or out-of-control drivers, who may run over the stands. Thus, a number of safety mechanisms have been developed for the stands to protect these drivers from injury. Generally, known mechanisms function by providing a location at which the sign stand may flex or pivot in response to the application of a force. The most common mechanisms involve the use of a flexible member or pivotal joint disposed at some point between the base and the sign mount. For example, in one common mechanism, the sign support member includes a coil or leaf spring disposed between the base and the sign mount. When a vehicle strikes the stand, the spring bends along the direction of the force. Once the force is removed, the spring returns the stand to the upright position.

While these bending spring mechanisms help to protect drivers from injury, they also have some drawbacks. First, the stands tend to be more expensive, as the springs add to the cost of manufacturing the stands. Second, the springs may flex under other ordinary forces, such as wind from passing vehicles, etc. This may cause the springs to fatigue and require eventual replacement, even if a vehicle never strikes the stand. Third, many of these designs are configured to flex along only one direction. Thus, if a vehicle hits the sign traveling in a direction transverse to the direction of the spring mechanism flex, the sign stand may fail to flex and cause injury to the driver or damage to the vehicle.

SUMMARY OF THE INVENTION

One aspect of the present invention provides a portable highway sign stand comprising a base and a sign support. The sign support is coupled to and extends upwardly from the base for supporting a highway sign above the ground. The sign support includes a generally rigid, generally upright portion having a first breakaway section yieldable along a first direction when subjected to a sufficient load at least partially along the first direction, and a second breakaway section yieldable along a second direction when subjected to a sufficient load at least partially along the second direction.

Another aspect of the invention provides a portable highway sign stand comprising a base, a sign support coupled to the base, and a sign mount disposed on the sign support. The sign support includes a pair of opposing, spaced-apart members extending upwardly from the base, the opposing members having upper ends. The sign mount is disposed on the sign support adjacent the upper ends of the opposing members. The opposing members include a breakaway section within which the opposing members are spaced more closely together than outside the breakaway section such that the susceptibility of the opposing members to bending is increased within the breakaway section.

Yet another aspect of the present invention provides a portable highway sign stand comprising a base, a sign support coupled to the base, and a sign mount coupled to the sign support. The sign support includes at least one member extending upwardly from the base portion to support the sign mount above the base. The sign mount is coupled to the upwardly extending member with a breakaway coupler. The breakaway coupler includes at least one lateral extension extending at least partially around the sign mount. The lateral extension is displacable by the sign mount when a sufficient load is exerted against the sign mount, permitting the highway sign to yield toward the ground.

DETAILED DESCRIPTION OF THE DEPICTED EMBODIMENTS

Figure 1:
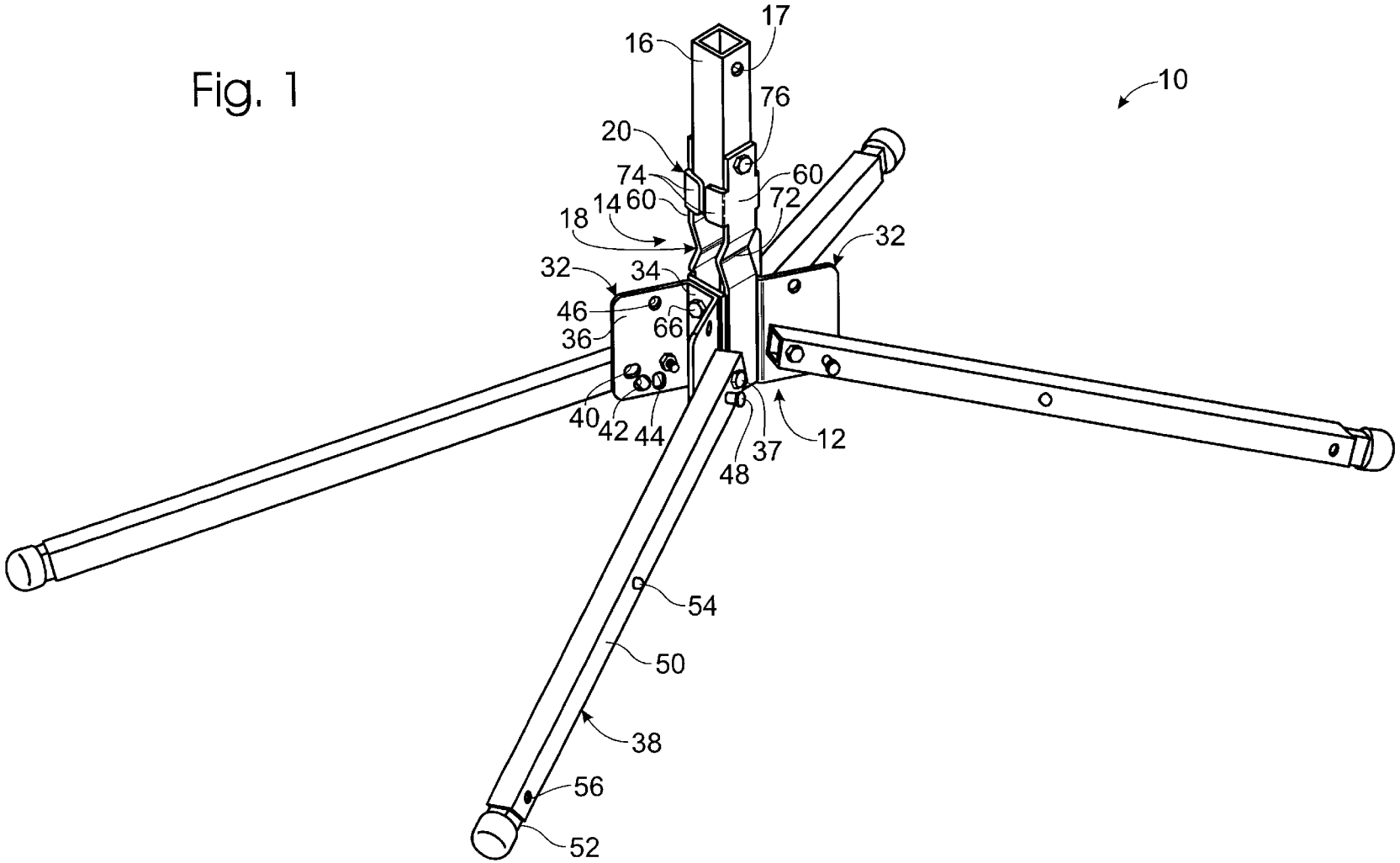
FIG. 1 is an isometric view of a first embodiment of the sign stand of the present invention.

The present invention provides a portable highway sign stand that employs novel breakaway mechanisms to permit the sign stand to collapse when struck by a passing vehicle. One embodiment of the present invention is shown generally at 10 in FIG. 1 as a portable highway sign stand configured to collapse along two different directions via two different breakaway mechanisms. Sign stand 10 includes a base 12, a sign support 14 extending upwardly from the base, and a sign mount 16 coupled to the upper end of sign support 14. Sign mount 16 includes a hollow metal member into which a sign post of a slightly smaller circumference (not shown) may be inserted, and has a hole 17 for fastening the sign post to the sign mount. The two breakaway mechanisms are located along sign support 14, and are indicated as first breakaway mechanism 18 and second breakaway mechanism 20. First breakaway mechanism 18 is configured to yield along a first direction when sign stand 10 is struck by a vehicle at least partially along the first direction, and second breakaway mechanism 20 is configured to yield along a second direction different from the first direction when sign stand 10 is struck by a vehicle at least partially along the second direction. In the depicted embodiment, the first and second directions are oriented 90 degrees from each other. However, it will be appreciated that the first and second directions may be oriented at any desired angle with respect to one another.

Figure 2:
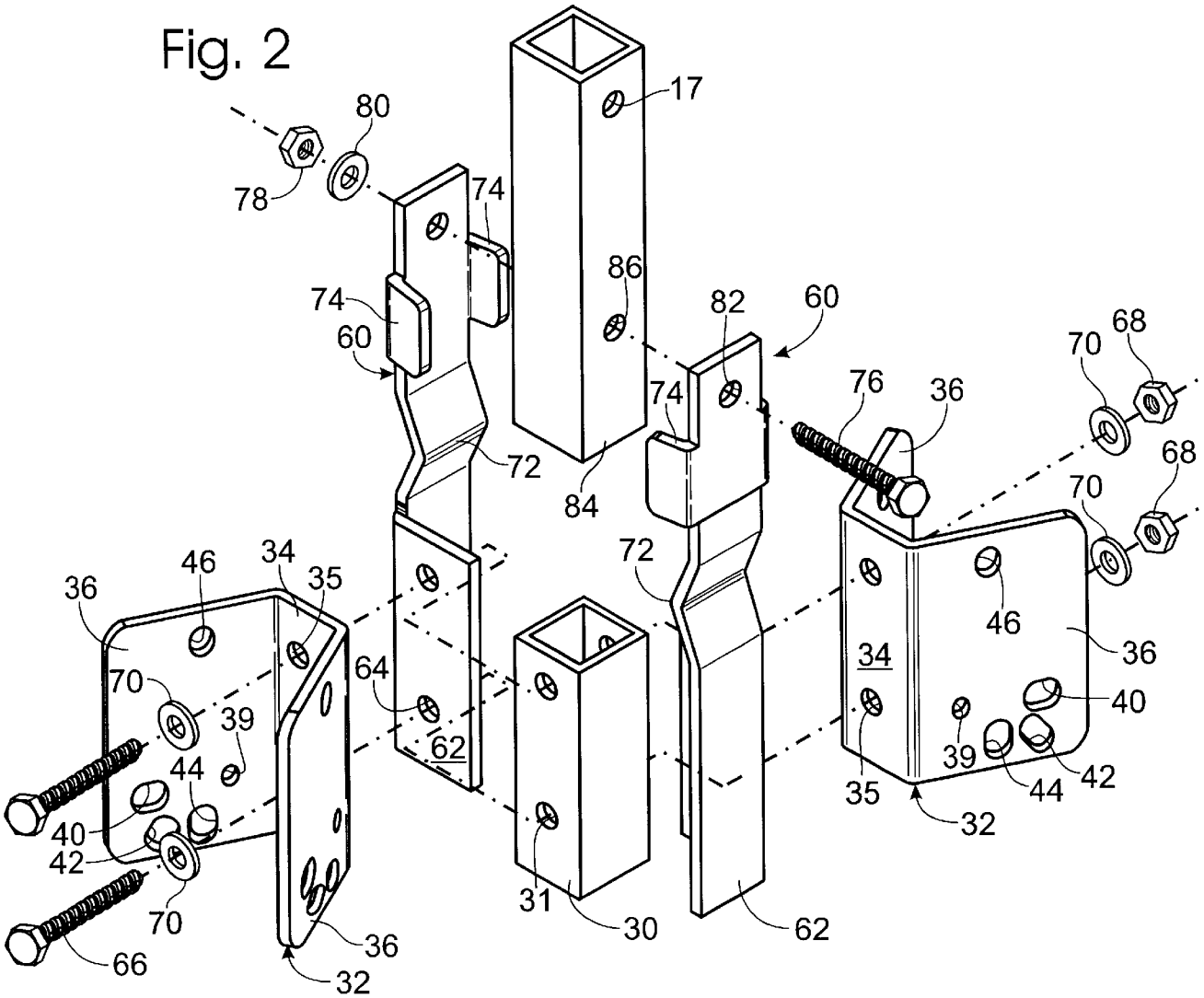
FIG. 2 is an exploded isometric view of the embodiment of FIG. 1.

Base 12 may have any desired configuration for supporting sign stand 12 against the ground. Referring to FIG. 2, base 12 of the depicted embodiment includes a central core piece 30 to which two opposing leg supports 32 are mounted. Core piece 30 includes a pair of mounting holes 31 for mounting leg supports 32 to the core piece. Each leg support 32 has three regions: a central region 34, and two angled extensions 36, one extending away from each side of central region 34. When mounted to core piece 30, leg supports 32 are positioned such that central regions 34 of both leg supports are oriented parallel to one another. Central region 34 of each leg support 32 may include a pair of holes 35 complementary to holes 31 for fastening leg support 32 to core piece 30, or may be attached to core piece 30 via another suitable method such as welding.

Base 12 may have as many legs as desired. In the depicted embodiment, one leg 38 is mounted to each angled extension 36, for a total of four legs. The angle at which angled extensions 36 extend from central region 34 is chosen to optimize the positions of legs 38 for maximum stability. Typically, sign stand 10 needs the most stability along the direction perpendicular to the face of a sign mounted on the stand, because the stand is subject to the greatest forces from winds hitting the sign along this direction. Thus, each leg 38 generally is angled less than 45 degrees from this direction.

Base 12, and sign stand 10 in general, may be constructed of any suitable material. Typically, it is desirable to utilize a material that can withstand severe impacts from vehicles without breaking, and is corrosion and oxidation resistant. Steel is a preferred material. Leg supports 32 are typically constructed from sheet steel, and legs 38 from tubular steel. These parts may be coated with a suitable coating, such as an electrostatic polyester coating, to further protect the stand from oxidation and weathering.

Legs 38 may be configured to be movable between several different positions relative to leg supports 32. This allows the positions of the legs relative to one another to be adjusted to compensate for rough or uneven surfaces. In the depicted embodiment, each leg 38 is pivotally attached to leg support 32 via a bolt 37 that extends through a hole 39 formed in each angled extension. Furthermore, four positional holes are provided to allow the legs to be fixed in one of three deployed positions and one storage position. The three deployed positions are indicated by position holes 40, 42 and 44, and the storage position is indicated by position hole 46. Legs 38 are held in a selected position by a spring-loaded pin 48 that extends through each leg 26 and into the position hole 40, 42, 44 or 46 corresponding to the selected position. Each leg 38 may be moved between positions by simply pulling pin 48 outward and moving leg 38 to a new position. When leg 38 reaches the new position, pin 48 automatically springs through the hole corresponding to that position, locking leg 38 in the new position. While spring-loaded pin 48 is a preferred mechanism for locking a leg 26 in a desired position, it will be appreciated that any suitable mechanism may be used. Furthermore, while the stand of the depicted embodiment has three deployed leg positions, the stand may have any number of deployed leg positions.

To provide for additional adjustability, the length of each leg 38 may be adjustable. In the depicted embodiment, each leg 38 is formed from two telescopically-arranged tubes, outer tube 50 and inner tube 52. The length of leg 38 may be made longer by pulling inner tube 52 partially out of outer tube 50, and may conversely be made shorter by pushing inner tube 52 farther into outer tube 50. Inner tube 52 may be locked in position relative to outer tube 50 by any suitable mechanism. In the depicted embodiment, a spring-loaded pin 54 that extends through various positional holes 56 along the length of outer tube 50 may be used to lock inner tube 52 in a desired position relative to the outer tube.

As mentioned above, sign stand 10 includes an upwardly extending sign support 14 coupled to base 12 for supporting sign mount 16 above base 12. Sign support 14 includes a pair of upwardly extending, spaced apart opposing members 60 configured to breakaway in at least one direction, and preferably in two different directions, when struck by a moving vehicle. Each opposing member 60 includes a lower mounting portion 62 coupled to base 12, and breakaway mechanisms 18 and 20, explained in more detail below.

Opposing members 60 may be configured to be attached to base 12 in any desired manner. In the depicted embodiment, mounting portion 62 has an angled shape configured to conform to two sides of rectangular core piece 30, and a pair of mounting holes 64. When the two opposing members 60 are fastened to core piece 30 opposite one another, the lower portions 62 of the two opposing members substantially surround the core piece. This, in turn, positions mounting holes 64 in line with holes 35 in leg supports 32 and holes 31 in core piece 30 so that all of these components may be joined with a single pair of bolts 66, nuts 68 and associated washers 70.

Above mounting portion 62, each opposing member 60 has a central portion with a generally flat cross-section, rather than an angled cross-section. First breakaway section 18 is formed in this region. First breakaway section 18 includes a curved section 72 of each opposing member 60, wherein each opposing member 60 curves inwardly toward the other opposing member. Curved section 72 provides a weakened region, or failure region, on sign stand 10 where failure of sign support 14 is easily initiated in a first direction perpendicular to the wide dimension of each opposing member 60.

Figure 4:
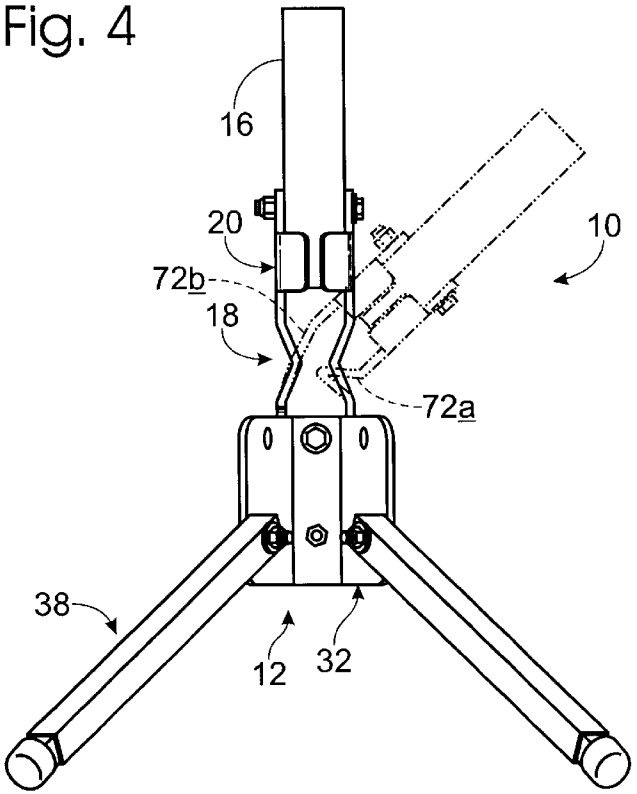
FIG. 4 is a front view of the embodiment of FIG. 1, showing the sign support yielding in a first direction at a first breakaway section.

The collapse of sign stand 10 via first breakaway section 18 is shown in more detail in FIG. 4. When a vehicle strikes stand at least partially along the first direction, curved section 72*a,* positioned on the opposite side of sign stand 10 as the impact, can buckle inward. At the same time, curved section 72*b,* positioned on the same side of sign stand 10 as the impact, can straighten out as curved section 72*a* buckles, further facilitating the collapse of sign stand 10. While curved sections are provided on both opposing members 60 in the depicted embodiment, alternatively a curved section may be provided on only one opposing member. Furthermore, while both curved sections 72 are shown in the depicted embodiment as curving inwardly toward each other, it will be appreciated that either one or both curved sections may curve outwardly from one another without departing from the scope of the present invention.

Above first breakaway portion 18, sign support 14 includes an upper region coupled to sign mount 16. Second breakaway section 20 is disposed in this region of sign support 14. Second breakaway section 20 includes a breakaway coupler that at least partially supports sign mount 16 in an upright position, but also allows sign mount 16 to yield toward the ground along the second direction when sign stand 10 is struck by a vehicle at least partially along the second direction.

Figure 3:
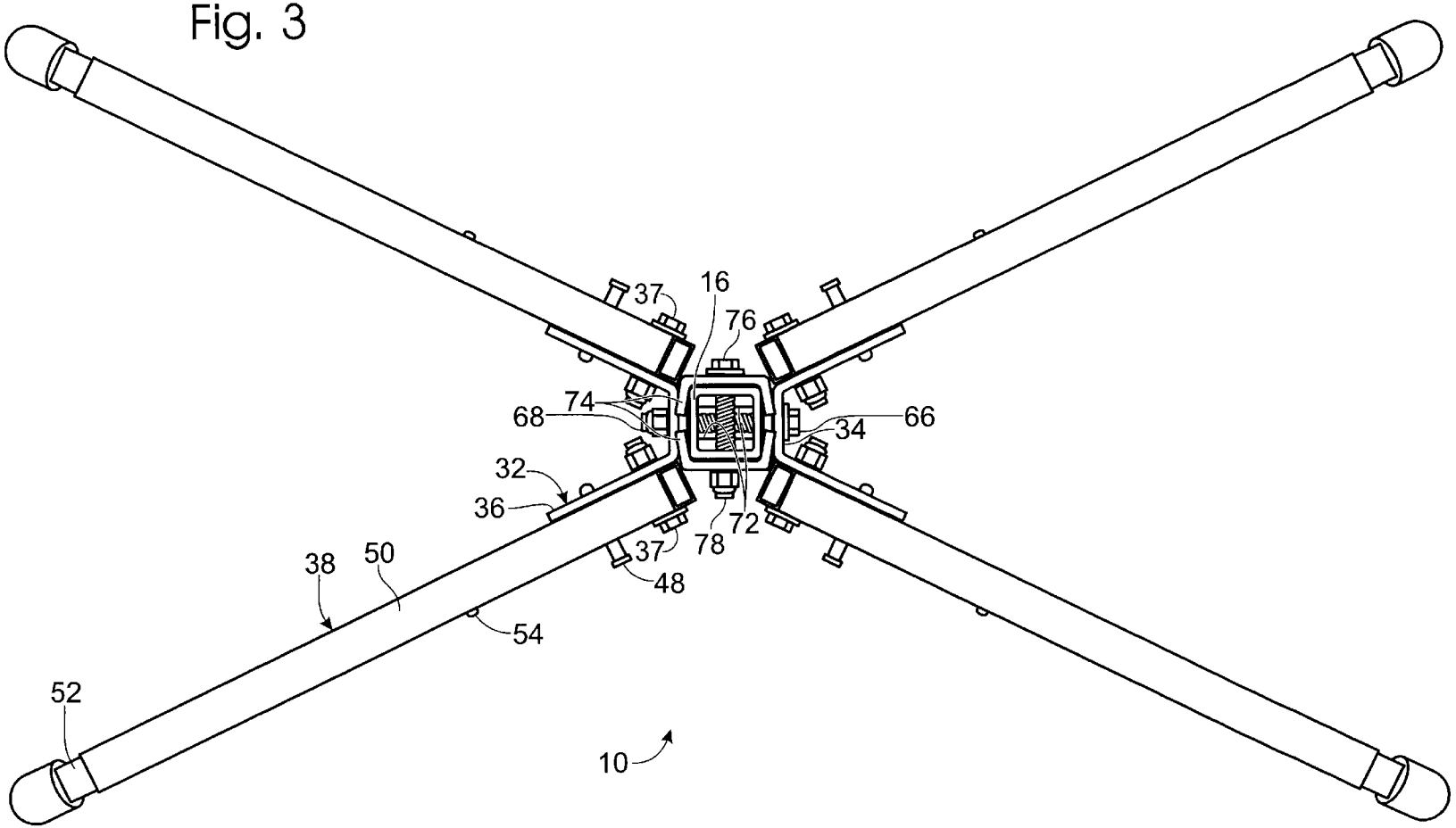
FIG. 3 is a top plan view of the embodiment of FIG. 1.

Referring to FIGS. 1–3, the breakaway coupler of second breakaway section 20 includes a pair of lateral, or transverse, extensions 74 that extend away from each side of each opposing member 60 to wrap partially around sign mount 16. Sign mount 16 is coupled to sign support 14 both with lateral extensions 74, and with another mechanism, such as bolt 76, nut 78 and washer 80. To accommodate bolt 76, each opposing member 60 includes a mounting hole 82, and sign mount 16 includes a complementary mounting hole 84. Bolt 76 prevents sign mount 16 from sliding vertically through lateral extensions 74. Likewise, lateral extensions 74 prevent sign mount 16 from pivoting toward the ground unless sign stand is struck by a vehicle with sufficient force to bend the lateral extensions from around sign post 16.

Bolt 76 may be positioned at any desired location along sign support 14. In the depicted embodiment, bolt 76 is positioned above lateral extensions 74. In this arrangement, the bottom portion 86 of sign mount 16 exerts a greater torque on transverse extensions 74 when hit by a vehicle than it would if bolt 76 were positioned at the same level as transverse extensions 74. While each opposing member 60 has two transverse extensions 74 extending from opposite sides of the opposing member around sign mount 16, both opposing members 60 may have either more or fewer transverse extensions without departing from the scope of the present invention.

Figure 6:
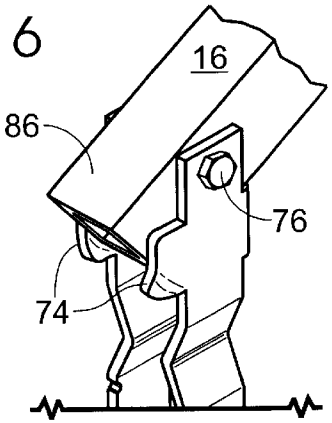
FIG. 6 is an isometric view of the second breakaway section, showing the sign support yielding in the second direction.
Figure 5:
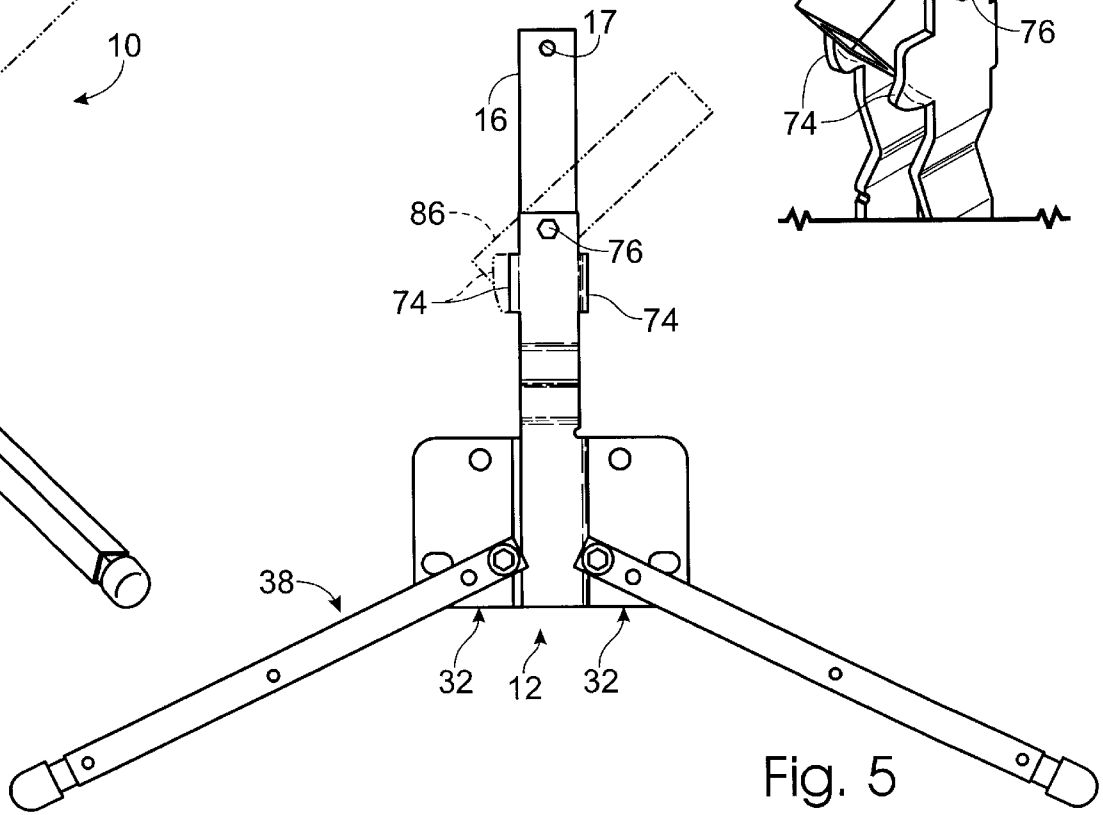
FIG. 5 is a side view of the embodiment of FIG. 1, showing the sign support yielding in a second direction at a second breakaway section.

The operation of second breakaway section 20 is illustrated in FIGS. 5–6. Second breakaway section 20 is configured to yield in a direction perpendicular to the long axis of bolt 76. When a vehicle hits sign stand 10 at least partially along this direction, bottom portion 86 of the sign mount pushes transverse extensions 74 outwardly, thus permitting movement of sign mount 16 toward the ground.

If sign stand 10 collapses at either breakaway section, the sign stand may be easily repaired by simply replacing opposing members 60. Because opposing members 60 are designed to be the weak point in sign stand 10, other portions of sign stand 10 may escape damage when the sign stand is struck by a vehicle, and therefore may not require replacement.

While the present invention has been particularly shown and described with reference to the foregoing embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

What is claimed is:

1. A portable highway sign stand, comprising:

a base;

a sign support coupled to the base and extending upwardly from the base for supporting a highway sign above the ground, the sign support including a generally rigid, generally upright portion having an upper end, a first breakaway section yieldable along a first direction when subjected to a sufficient load at least partially along the first direction, and a second breakaway section disposed above the first breakaway section and yieldable along a second direction transverse to the first direction when subjected to a sufficient load at least partially along the second direction, the second breakaway section including a coupler disposed adjacent the upper end of the upright portion for coupling a sign mount to the upright portion, the coupler at least one lateral extending from the upright portion at least partially around the sign mount.

2. The sign stand of claim 1, wherein the first breakaway section includes a narrowed section in the upright portion that has an increased susceptibility to bending relative to the other sections of the upright portion.

3. The sign stand of claim 1, wherein the upright portion includes two upwardly extending, spaced-apart, opposing members.

4. The sign stand of claim 3, wherein the first breakaway section includes a portion of one of the opposing members that is curved inwardly toward the other opposing member.

5. The sign stand of claim 3, wherein the first breakaway section includes a portion of the opposing members in which each opposing member is curved inwardly toward the other opposing member.

6. The sign stand of claim 1, wherein the coupler is displaceable by the sign mount when the sign mount exerts a sufficient load against the coupler in a predetermined direction, permitting the sign mount to yield toward the ground.

7. The sign stand of claim 6, wherein the upright portion includes two upwardly extending, spaced-apart, opposing members between which the sign mount is disposed, and wherein the coupler includes said at least one lateral extension from each opposing member that extends at least partially around the sign mount.

8. The sign stand of claim 7, wherein the coupler includes two lateral extensions on each opposing member that extend in opposite directions from the opposing member partially around the sign mount.

9. The sign stand of claim 8, wherein the two opposing members are generally flat and generally parallel to one another, and wherein the second breakaway section is configured to allow the sign mount to collapse in a direction generally parallel to the opposing members.

10. The sign stand of claim 8, wherein the sign mount is pivotally fixed to the opposing members such that the sign mount may pivot toward the ground when subjected to a sufficient load by displacing the lateral extensions.

11. The sign stand of claim 10, wherein the sign mount is pivotally fixed to the opposing members with a bolt extending through the opposing members and the sign mount.

12. The sign stand of claim 10, the sign mount including a lower end, wherein the sign mount is pivotally fixed to the opposing members above the extensions to increase the torque of the lower end of the sign mount against the lateral extensions.

13. The sign stand of claim 1, wherein the base includes a plurality of legs.

14. The sign stand of claim 13, wherein at least one of the legs is pivotally mounted to the base.

15. The sign stand of claim 13, each leg having a length, wherein the length of at least one leg is adjustable.

16. A portable highway sign stand, comprising:

a base for supporting the sign stand against the ground;

a sign mount for mounting a highway sign to the sign stand; and a breakaway support disposed between the base and the sign mount, the breakaway support including a pair of opposing upright members extending from the base to the sign mount, each of the opposing members including a first breakaway section configured to fail along a first direction when subjected to a sufficient load along the first direction and a second breakaway section configured to fail along a second direction transverse to the first direction when subjected to a sufficient load along the second direction, wherein the second breakaway section includes a transverse extension disposed on the breakaway support, the transverse extension extending at least partially around the sign mount to support the sign mount in an upright position, the transverse extension being displaceable from round the sign mount to allow the sign mount to yield toward the ground when subjected to a sufficient load.

17. The portable highway sign stand of claim 16, wherein the first breakaway section includes a narrowed section of the breakaway support in which one of opposing upright members is bent inwardly toward the other.

18. A portable highway sign stand, comprising:

a base;

a sign support coupled to the base; and a sign mount disposed on the sign support, the sign support including a pair of opposing, spaced-apart members extending upwardly from the base, the opposing members having upper ends, the sign mount being disposed on the sign support adjacent the upper ends of die opposing members, wherein the opposing members include a first breakaway section within which the opposing members are bent inwardly toward one another such that the susceptibility of the opposing members to bending along a first direction is increased within the breakaway section, and wherein the opposing members include a second breakaway section disposed above the first breakaway section, the second breakaway section including a coupler that couples the sign mount to the sign support, the coupler including a lateral extension that extends at least partially around the sign mount, the lateral extension being displaceable from around the sing mount when the sign mount exerts a sufficient force against the lateral extension at least partially along a second direction.

19. The portable highway sign stand of claim 18, wherein the opposing members are generally parallel outside of the first breakaway section and are curved toward one another in the first breakaway section.

20. A portable highway sign stand, comprising:

a base;

a sign support coupled to the base and extending upwardly from the base for supporting a highway sign above the ground, wherein the sign support includes a generally rigid, generally upright portion including two upwardly extending, spaced-apart, opposing members having a first breakaway section yieldable along a first direction when subjected to a sufficient load at least partially along the first direction and a second breakaway section yieldable along a second direction when subjected to a sufficient load at least partially along the second direction, and wherein the upright portion has an upper end; and a sign mount coupled to the upper end of the upright portion between the opposing members, wherein each opposing member includes two lateral extensions extending at least partially around the sign mount, and wherein the sign mount is pivotally fixed to the opposing members above the lateral extensions.

21. A portable highway sign stand, comprising:

a base for supporting the sign stand against the ground;

a sign mount for mounting a highway sign to the sign stand; and a breakaway support disposed between the base and the sign mount, the breakaway support including a pair of opposing upright members extending from the base to the sign mount, each of the opposing members including a first breakaway section configured to fail along a first direction when subjected to a sufficient load along the first direction and a second breakaway section configured to fail along a second direction when subjected to a sufficient load along the second direction, wherein the second breakaway section includes a transverse extension disposed on the breakaway support, the transverse extension extending at least partially around the sign mount to support the sign mount in an upright position, the transverse extension being displaceable from around the sign mount to allow the sign mount to yield toward the ground when subjected to a sufficient load.

22. The portable highway sign stand of claim 21, wherein the opposing upright members are generally flat, and wherein the first breakaway section includes a curve in at least one of the opposing upright members toward the other opposing upright member, the curve being positioned below the transverse extension.

* * * * *